US006004051A

United States Patent [19]

Hu

[11] Patent Number: 6,004,051

[45] Date of Patent: Dec. 21, 1999

[54] KEY STRUCTURE OF COMPUTER KEYBOARD

[75] Inventor: Gino Hu, Taipei, Taiwan

[73] Assignee: Silitek Corporation, Taipei, Taiwan

[21] Appl. No.: 09/215,543

[22] Filed: Dec. 18, 1998

[51] Int. Cl.[6] ..... H01H 13/70

[52] U.S. Cl. ..... 400/491.2; 200/344

[58] Field of Search ..... 400/472, 480, 400/481, 490, 491, 491.1, 491.2, 495, 495.1, 496; 200/5 A, 512, 513, 514, 515, 516, 517, 520, 341, 344, 345, 342, 343; 361/680

[56] References Cited

U.S. PATENT DOCUMENTS 4,580,022 4/1986 Oelsch et al. ..... 200/340
5,819,914 10/1998 Yoneyama ..... 200/344
5,941,373 8/1999 Cheng ..... 200/344

*Primary Examiner*—Ren Yan
*Assistant Examiner*—Amanda B. Sandusky
*Attorney, Agent, or Firm*—Rosenberg, Klein & Lee

[57] ABSTRACT

A key structure of computer keyboard includes a base, a conductive film, an elastic member, a frame, and a cap. A plurality of coupling parts including sliding grooves are arranged on the cap and the base. The frame has a plurality of pivoting shafts arranged within the sliding grooves such that the frame can be pressed down. The top and bottom ends of the elastic member are fixed between the cap and the conductive film such that the elastic member will not leap out when the key structure is disassembled. A clamping device is arranged between the cap and the base such that the key will not shake when pressed.

3 Claims, 4 Drawing Sheets

KEY STRUCTURE OF COMPUTER KEYBOARD

FIELD OF THE INVENTION

The present invention relates to a key structure of a computer keyboard, especially to a key structure of a computer keyboard having a base, a conductive film, an elastic member, a frame, a cap, sliding grooves as the coupling parts on the base and the cap, where the key will not shake when being pressed.

BACKGROUND OF THE INVENTION

A key 20 in a conventional keyboard, as shown in FIG. 4, comprises a metal base 81, a conductive film 82, a plastic plate 83, an elastic member 84, a frame 85 and a cap 86. Moreover, corresponding coupling parts 811 and 861 are arranged on the metal base 81 and the cap 86, respectively. The frame 85 comprises a first rack 851 and a second rack 852 pivotably connected to each other. Two locking parts 853 and 854 corresponding to the coupling part 811 and 861 of the metal plate 81 and cap 86 are arranged on the first rack 851 and the second rack 852, respectively, whereby the cap 86 moves upward and downward.

However, the conventional keys 20 lie on the elastic member 84 and have no supporting elements on lateral sides thereof. Thus, the keys 20 may experience instability, i.e., shaking, when being pressed.

SUMMARY OF THE INVENTION

Therefore, it is an object of the present invention to provide a key structure of computer keyboard which does not shake when being pressed.

It is another object of the invention to provide a key for computer keyboard the elastic member of which will not leap out when the key is opened for repair.

To achieve above objects, the present invention provides a key structure of computer keyboard having a base, a conductive film, an elastic member, a frame, and a cap. A plurality of coupling parts are arranged on the cap and the base, wherein the coupling parts are sliding grooves. The frame has a plurality of pivoting shafts arranged within the sliding grooves such that the frame can be pressed down. Both sides of the elastic member are fixed between the cap and the conductive film such that the elastic member will not leap out. A clamping device is arranged between the cap and the base such that the key will not shake when being pressed.

The various objects and advantages of the present invention will be more readily understood from the following detailed description when read in conjunction with the appended Drawing, in which:

DETAILED DESCRIPTION OF THE PREFERRED EMBODIMENT

Figure 1:
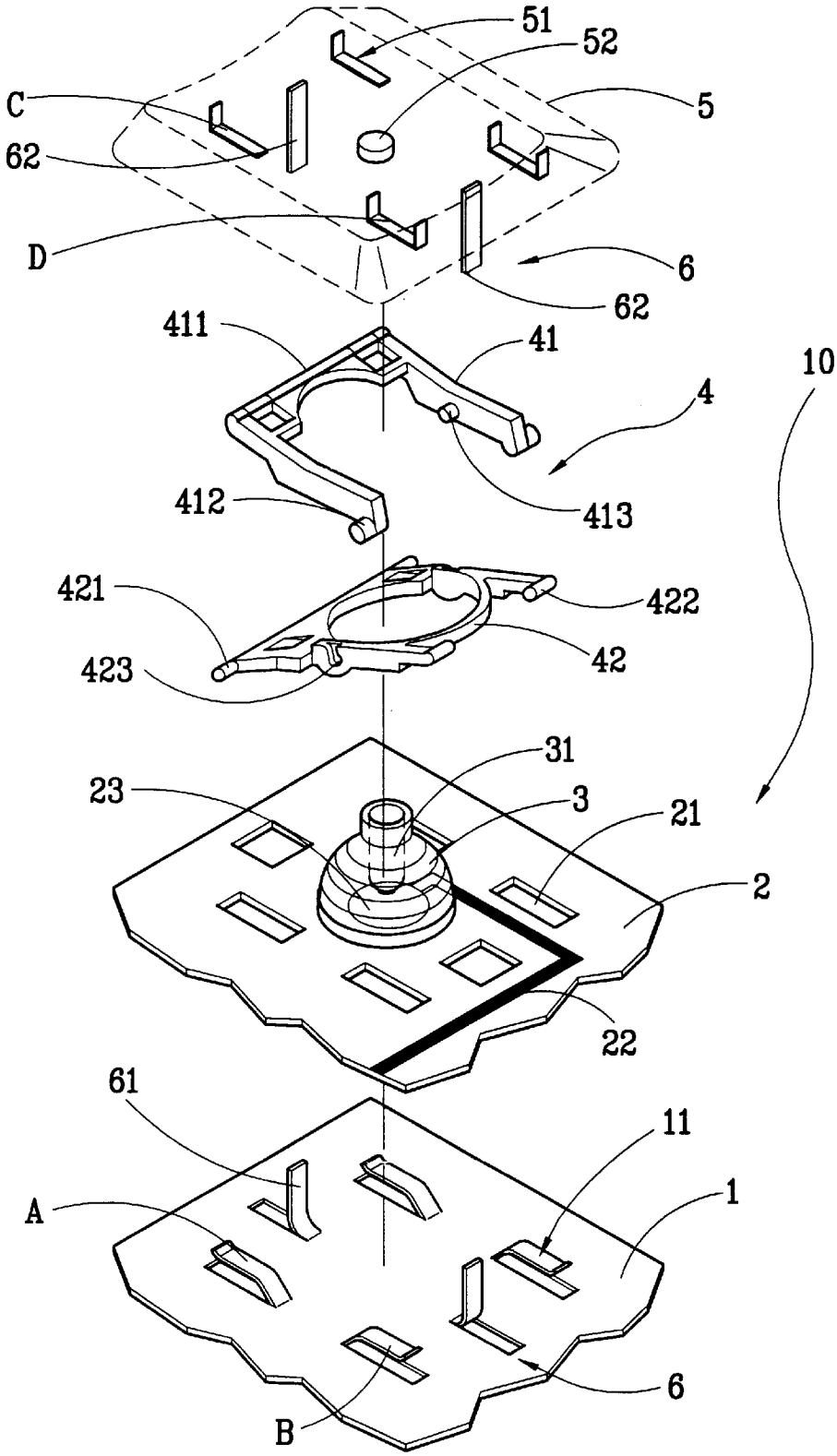
FIG. 1 is an exploded view of the present invention.

As shown in FIG. 1, the inventive key 10 comprises a base 1, a conductive film 2, an elastic member 3, a frame 4 and a cap 5. Moreover, four coupling parts 11 are arranged on the base 1 and four coupling parts 51 are arranged on the cap 5. The coupling parts 11 are composed of sliding grooves A and B, while the coupling parts 51 include sliding grooves C and D.

Figure 2:
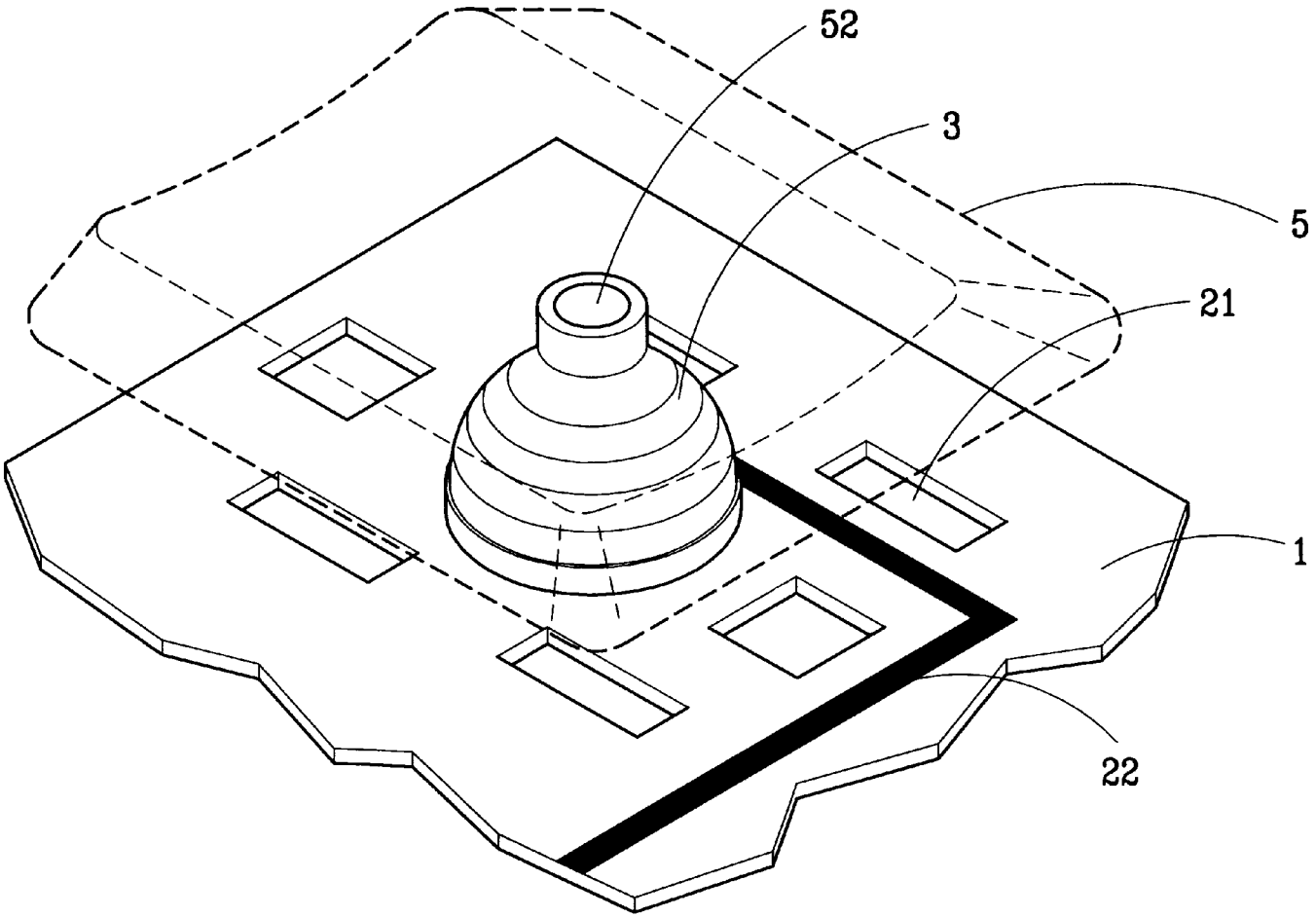
FIG. 2 shows the state of the elastic element attached between the cap and the conductive film according to the present invention.

The conductive film 2 is arranged upon the base 1 and has an opening 21 corresponding to the coupling part 11 of the base 1 such that the coupling part 11 projects from the opening 21 when the conductive film 2 is put upon the base 1. The conductive film 2 is provided with circuit 22 and the electric contact 23. As shown in FIG. 2, the elastic member 3 is placed between the conductive film 2 and the bump 52 of the cap 5. When the cap 5 is pressed, the elastic member 3 is pushed down thereby bringing the conductive pin 31 of the elastic member 3 in contact with the electric contact 23 of the conductive film 2.

The frame 4 comprises a first rack 41 and a second rack 42 which are pivotably connected. The width of first rack 41 is slightly larger than that of the second rack 42 such that the first rack 41 can be pivotably arranged on the outer side of the second rack 42. The first rack 41 is of a U-shape and has a shaft 411 on the closed end thereof, which is arranged within the sliding groove C on the left side of the cap 5. Poles 412 extend on the opened end of the first rack 41 and are arranged within the sliding groove B on the right side of the base 1. The first rack 41 has ties 413 each projecting on the central part of its arms. One side of the second rack 42 is provided with a pivoting shaft 421 arranged within the sliding groove A on left side of the base 1. Another side of the second rack 42 is provided with a pivoting shaft 422 arranged within the sliding groove D on the right side of the cap 5. Moreover, the second rack 42 has a pair of engaging grooves, each corresponding to a respective tie 413 of the first rack 41 such that each tie 413 can be pivotably arranged within the corresponding engaging groove 423.

In the present invention, clamping means 6 are provided between the base 1 and the cap 5 wherein the clamping means 6 comprise a first blocking plate 61 on each of the left and right sides of the base 1, respectively, and a pair of second blocking plates 62 on the cap 5, each arranged in engagement with a respective first blocking plate 61. By engaging the first blocking plates 61 and the second blocking plates 62, the cap 5 can be prevented from shaking.

Figure 3:
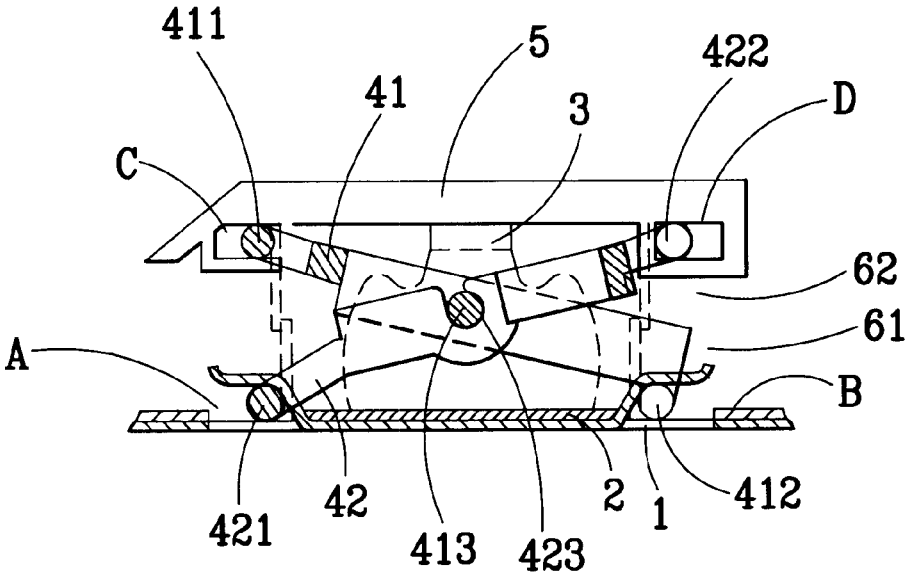
FIG. 3 is a cross-section view showing an embodiment of the present invention.
Figure 3:
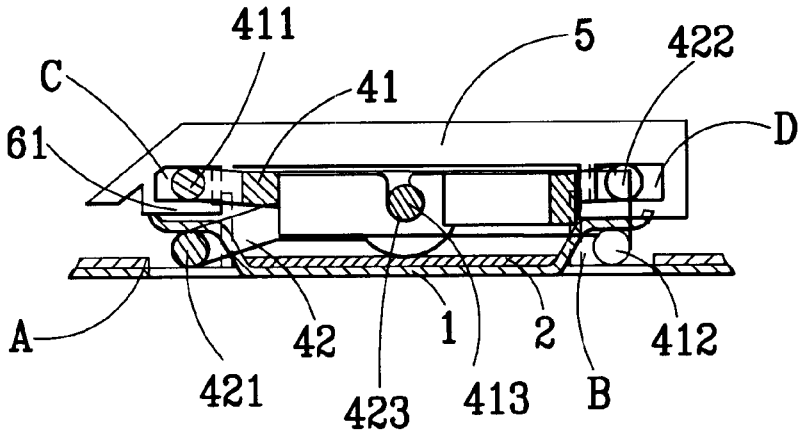
Figure 4:
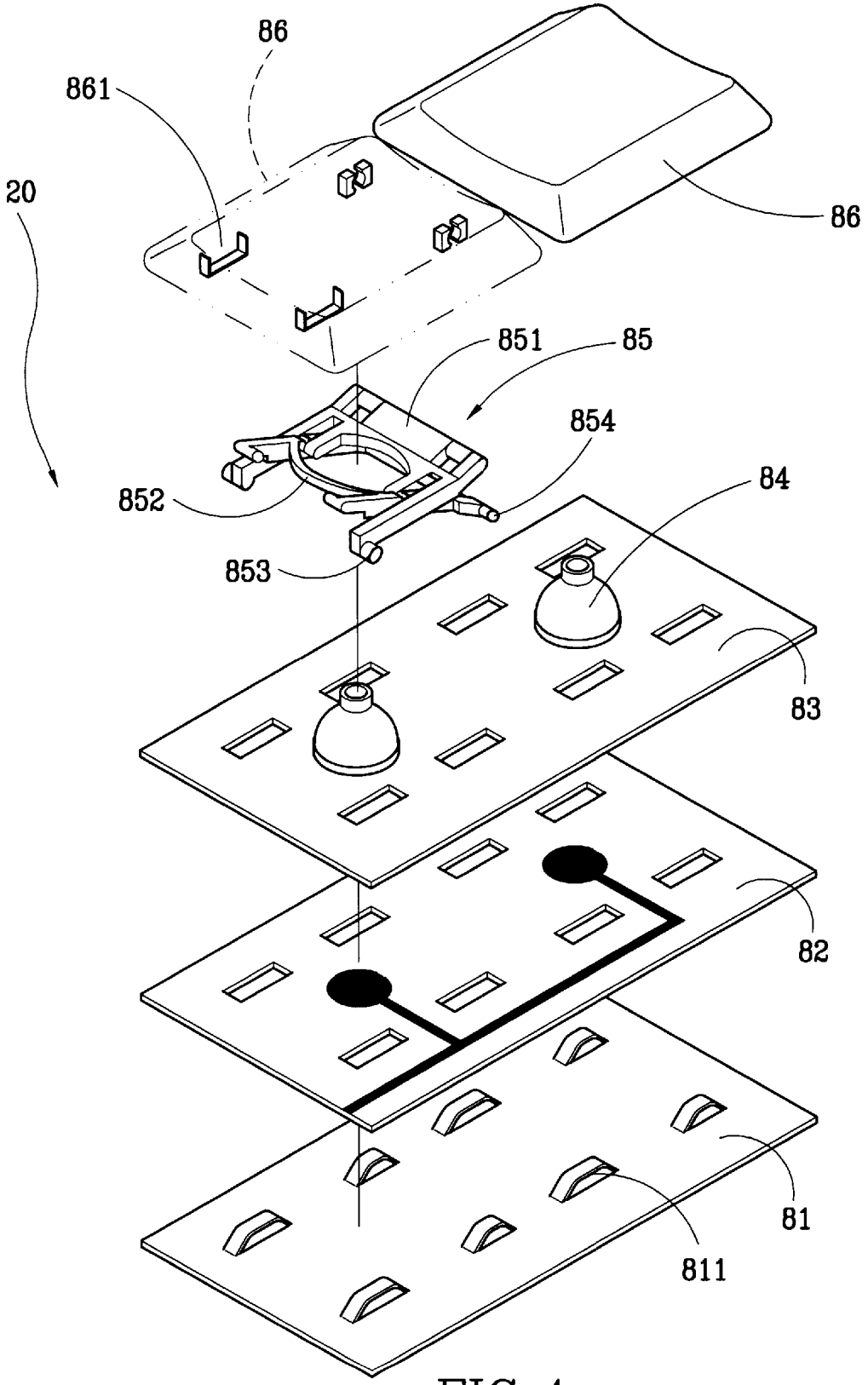
FIG.4 PRIOR ART
FIG. 4 is an exploded view of a conventional key.

With reference now to FIG. 3, showing the cross section view of a preferred embodiment of the present invention, the pivoting shafts 411, 412, 421, 422 of the first rack 41 and the second rack 42 can be engaged within the coupling parts 11 and 51 (sliding grooves A, B, C and D) of the base 1 and the cap 5, respectively. One of two ends of the elastic member 3 is attached to the bump 52 of the cap 5, while another end of the elastic member 3 is attached to the conductive film 2. Moreover, the first blocking plate 61 on the base 1 engages the second blocking plate 62 on the cap 5. When the cap 5 is pressed down by a user, the pivoting shafts 411, 412, 421, 422 within the sliding grooves A, B, C and D are moved toward one side. The cap 5 is therefore moved down to press the elastic member 3. The conductive pin 31 of the conductive film 2 within the elastic member 3 touches the electric contact 23, thus forming a conductive loop.

In the present invention, the clamping means 6 are provided between the cap 5 and the base 1 such that the cap 5 will not shake when the key 10 is pressed. Thus, the key 10 can be stably pressed. The keyboard in the present invention does not adopt conventionally-used plastic plate, the assembling of the keyboard 10 is more convenient. Moreover, both ends of the elastic member 3 are attached between the bump

52 of the cap 5 and the conductive film 2. Thus, the elastic member 3 will not leap out when the keyboard 10 is disassembled.

Although the present invention has been described with reference to the preferred embodiment thereof, it will be understood that the invention is not limited to the details thereof. Various substitutions and modifications other than those discussed in the foregoing description may be resorted to without departing from the scope of the invention as defined in the appended claims.

I claim:

1. A key structure of a computer keyboard, comprising:

a base, an elastic member, a frame, a conductive film and a cap, said base having four sliding grooves forming a plurality of coupling parts;

said conductive film having openings at locations corresponding to said coupling parts of said base, said coupling parts projecting from said openings when said conductive film is placed upon said base, said conductive film further having circuit and an electric contact;

said frame having a first rack and a second rack pivotably arranged with said first rack in cross relationship, both sides of each of said first rack and said second rack being provided with pivoting shafts;

said cap having four sliding grooves forming a plurality of coupling parts, said pivoting shafts of said first rack and said second rack being pivotably arranged into said coupling parts of said cap and said base;

said elastic member having two ends and a conductive pin, one of said two ends being connected to said conductive film and the other of said two ends being connected to said cap, said conductive pin of said elastic member being in contact with said electrical contact of said conductive film when said elastic member is pressed; and clamping means arranged between said base and said cap for preventing said cap from shaking when said key is pressed.

2. The key structure as in claim 1, wherein said first rack is of U-shape having a closed end, an opened end and side arms, said closed end having a first of said pivoting shafts engaged into said coupling part on the left side of said cap; said opened end of said U-shaped first rack having outwardly extending second of said pivoting shafts engaged into said coupling part on the right side of said base, said second rack having other of said pivoting shafts on both ends thereof engaging into said coupling parts on the right side of said cap and the left side of said base, respectively, said first rack having a pair of ties extending inwardly on said side arms thereof, said second rack having a pair of engaging grooves at locations corresponding to said ties of said first rack, such that each said tie is engaged into a respective one of said engaging grooves.

3. The key structure as in claim 1, wherein said clamping means comprise first blocking plates arranged on the left side and right side of said base, said cap having second blocking plates, each arranged on a location corresponding to a respective one of said first blocking plates and engaging with said respective first blocking plate.

* * * * *